United States Patent [19]

Levy

[11] Patent Number: 4,543,672

[45] Date of Patent: Oct. 1, 1985

[54] BELT CONSTRUCTION

[76] Inventor: Ellen R. Levy, 136 Waverly Pl., New York, N.Y. 10014

[21] Appl. No.: 439,580

[22] Filed: Jan. 7, 1983

[51] Int. Cl.[4] ..... A41F 9/00

[52] U.S. Cl. ..... 2/321; 2/338

[58] Field of Search ..... 2/338, 339, 314, 315, 2/320, 321, 322

[56] References Cited

U.S. PATENT DOCUMENTS

| | | | |
|---|---|---|---|
| Re. 6,310 | 3/1875 | Chipley . | |
| 886,780 | 5/1908 | Dwyer | 2/322 |
| 1,119,296 | 12/1914 | Malsin . | |
| 1,697,270 | 1/1929 | Fischer | 2/317 |
| 1,993,310 | 3/1935 | Schreiber . | |

FOREIGN PATENT DOCUMENTS

| | | |
|---|---|---|
| 637344 | 4/1928 | France . |

*Primary Examiner*—Doris L. Troutman

*Attorney, Agent, or Firm*—Willian Brinks Olds Hofer Gilson & Lione

[57] ABSTRACT

A belt or other band-like article adapted to be worn around the waist, hips or other body part of a user and with or without a separate buckle. The belt includes a length of material having a free end and a loop loosely retained at its other end. The belt is worn in one mode by wrapping it around the user's waist and passing the free end through the loop. After being pulled taut, the free end is passed under and around the belt beyond the loop, doubled back on itself, and passed back through the loop. In another mode, a separate buckle is secured on the belt by passing the free end through the buckle and then through the loop. The belt is then secured around the user's waist using the buckle in the manner described above for the loop.

15 Claims, 15 Drawing Figures

Fig. 1
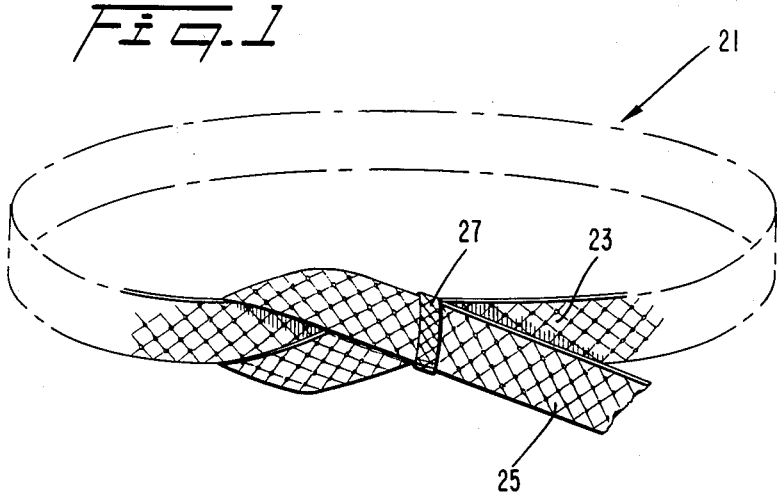
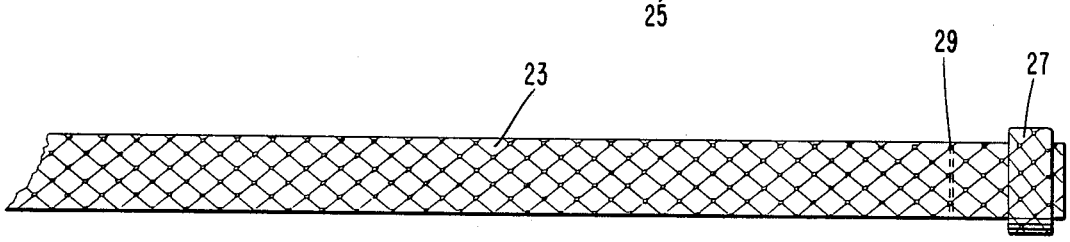
Fig. 2
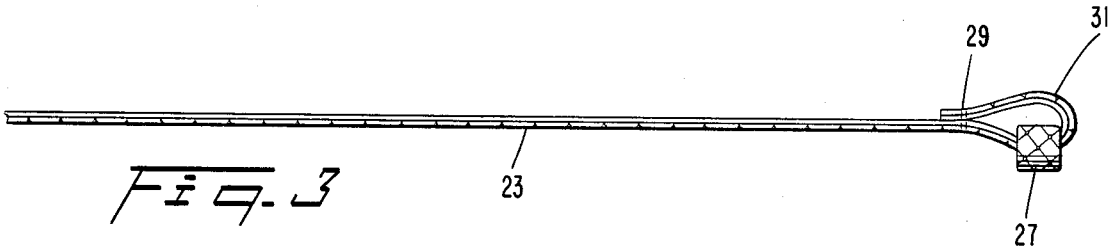
Fig. 3
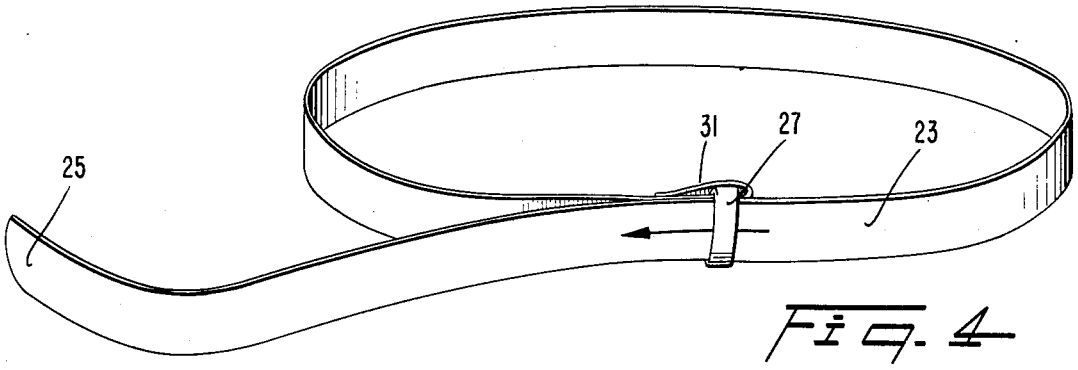
Fig. 4
Fig. 5
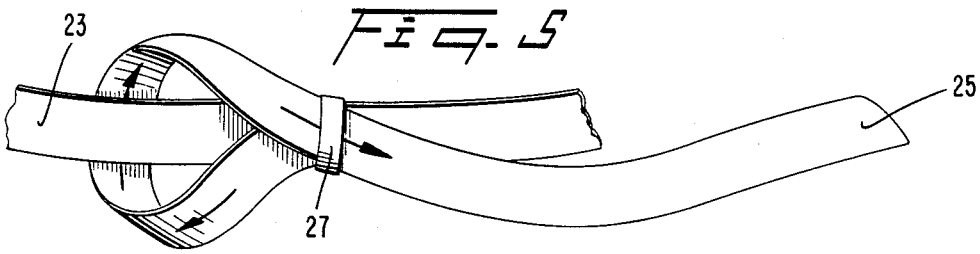

BELT CONSTRUCTION

BACKGROUND OF THE INVENTION

The present invention relates to belts, and more particularly to a universal belt which can be used with or without a separate buckle, and to a method of tying a belt. For simplicity, the present invention will be described as a belt worn around the waist of a user. It will be understood, however, that the belt can be worn around the hips, and that the invention finds use in other band-type articles worn around other body parts such as bracelets, necklaces, chokers, head bands, etc.

Belts are usually formed of a length of material having one free end and a buckle secured at the other end. These belts are cut to various lengths according to the size of the user's waist, and the most common type is provided with a number of spaced apertures at the free end. When the belt is wrapped around the user's waist, the free end is passed through the buckle and pulled taut, and a pivotal catch on the buckle is passed through an appropriate opening in the belt free end to secure the belt in place. Other types of belts do not have spaced apertures but incorporate a catch in the buckle which grips the belt free end.

In both cases, the belts typically can only be worn in this one mode and with a single buckle. Those which can be used with interchangeable buckles employ complex or cumbersome fasteners so that changing from one buckle to another is difficult. Thus, typical users, particularly women, must purchase a number of different belt styles for their wardrobes or are faced with difficult procedures when changing from one buckle to another. Also, it is required that several belt lengths in each style be manufactured and stocked for users having different waist sizes since the range of waist sizes accommodated by a particular belt is generally very small.

SUMMARY OF THE INVENTION

The present invention overcomes the problems and disadvantages of the prior art by providing a belt which may be worn with or without a buckle and which is nearly universal in length so that it can accommodate a large range of waist sizes. In addition, the belt of this invention can be worn with a number of different buckles and change from one buckle to another is fast and simple so that a single belt and a plurality of interchangeable buckles can serve a wide variety of clothing moods. Still further, the present invention includes a novel method of tying the belt described above which produces a neat and stylish appearance.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the belt or band-like article of this invention comprises a length of material having one free end and a small loop retained at the other end of the belt, the loop being adapted to receive the free end of the belt after the belt is wrapped around a user's waist, hips, or other body part, the free end, after the belt is pulled taut, is then adapted to be passed under and around the belt beyond the loop, and then manipulated to tie a knot in the belt to secure it in place. In a preferred form, the knot is tied by doubling the free end of the belt back on itself, and passing it back through the loop to lock the belt in place, although it will be understood that the knot can also be formed by inserting the free end through the wrapping formed when the free end is passed under and around the belt beyond the loop.

Also, in a preferred form, the loop is loosely retained on the belt so that it can be positioned at the front or rear side of the belt. The belt, with the loop positioned at its front side, is tied in the manner described above, and with the loop positioned at the rear side thereof, is adapted to have a separate buckle positioned thereon and secured in place by passing the free end through the buckle and then through the loop and pulling the belt tight on the buckle, whereupon the belt can be secured in place by again passing the free end through the buckle, pulling the belt taut, passing the free end under and around the belt beyond the buckle, and manipulating the free end to tie a knot in the belt. Again, in the preferred form, the knot is tied by doubling the free end back on itself and passing it back through the buckle, although it can be achieved by inserting the free end through the wrapping formed when the free end is passed under and around the belt beyond the buckle.

Preferably, the loop is retained on the belt by an eyelet formed by folding a short length of the belt back on itself and securing it to the belt. Also, the loop can be formed of the same material as the belt or of a different material. Finally, after the belt is secured around a user's waist, any excessive length of the free end may be tied by wrapping it around and under the belt again and passing it through the wrapping.

In another aspect, the belt or band-like article of this invention is adapted to be worn around the waist, hips or other body part of a user and comprises a length of material which is uninterrupted by openings and which includes a free end and a loop loosely carried at the other end, the belt being adapted to be worn in one mode wherein the free end of the belt is passed through the loop after the belt is wrapped around the user's waist, hips, or other body part, and the free end, after the belt is tightened, is adapted to be passed under and around the belt beyond the loop, doubled back on itself, and passed back through the loop to secure the belt in place. The belt is adapted to be worn in another mode wherein a separate buckle is positioned and retained on the belt by passing the free end of the belt through the buckle and then back through the loop. In this mode, the belt is secured in place by passing the free end through the buckle again and pulling the belt taut, passing the free end under and around the belt beyond the buckle, doubling it back on itself, and passing it back through the buckle.

In still another aspect, the belt or band like article of this material comprises a length of material having a free end and a loop at the other end, the loop positioned at the rear side of the belt, the belt adapted to have a buckle retained thereon by passing the free end through the buckle and through the loop, the belt, with the buckle thereon, adapted to be worn around the waist, hips or other body part of a user by passing the free end through the buckle again and pulling it taut, passing the free end under and around the belt beyond the buckle, and manipulating the free end to tie a knot in the belt.

In yet another aspect, the invention relates to a method of tying a belt or band-like article which includes the steps of providing a belt constructed of a length of material having a free end and a loop retained at its other end, wrapping the belt around the waist, hips or other body part of a user, passing the free end of the belt through the loop, passing the free end under and around the belt beyond the loop, and then manipulating the free end to tie a knot in the belt. In a preferred method, the knot is formed by doubling the free end of the belt back on itself and passing it back through the loop, although it can be achieved by passing the free end through the wrapping formed when the free end is passed under and around the belt beyond the loop.

The method of the invention further includes the steps of providing a belt as described above wherein the loop is loosely retained on the belt and can be positioned at either the front or rear side of the belt and wherein the belt is tied as described above when the loop is on the front side of the belt. This belt can also be tied in a method using a separate buckle which includes the steps of positioning the loop at the rear side of the belt, passing the free end of the belt through the buckle and then the loop to secure the buckle in place, wrapping the belt around the waist or other body part of the user, passing the free end through the buckle, passing the free end under and around the belt beyond the buckle, and then manipulating the free end to tie a knot to secure the belt in place. Preferably, the knot is formed by doubling the free end back on itself and passing it back through the buckle.

The accompanying drawings, which are incorporated in and constitute a part of this specification, illustrate the invention, and, together with the description, serve to explain the principles of the invention.

BRIEF DESCRIPTION OF THE DRAWINGS

FIG. 1 is a perspective view showing a preferred belt of this invention secured in place as it would be around a user's waist or hips;

FIG. 2 is an enlarged plan view of a portion of the belt of FIG. 1 shown unwrapped;

FIG. 3 is an elevational view of the structure of FIG. 2;

FIG. 4 is a perspective view showing a first step of securing the belt of FIGS. 1–3 around a user's waist;

FIG. 5 is a view similar to FIG. 4 and showing a next step of securing the belt in place around the waist of a user;

DESCRIPTION OF THE PREFERRED EMBODIMENT

Figure 6:
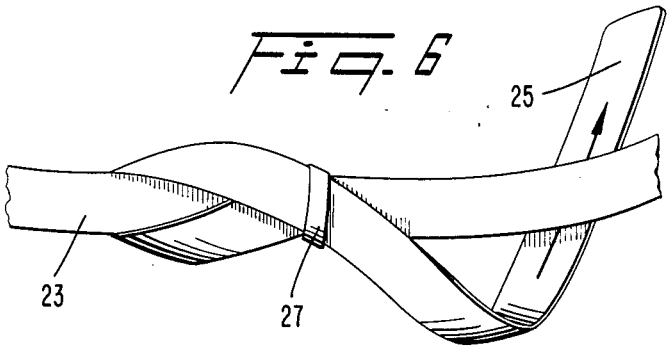
FIG. 6 is a view similar to FIG. 5 and showing a further step which may be incorporated in a belt of excessive length.

Reference will now be made in detail to the present preferred embodiment of the invention, an example of which is illustrated in the accompanying drawings.

The preferred embodiment of belt of the present invention is shown in FIG. 1 and is represented generally by the numeral 21. In accordance with the invention and as embodied herein, the belt 21 includes an elongated length of material 23 having a free end 25 and a loop 27 carried at the other end thereof. Preferably, a short length of the belt material is folded back on itself at the other end and is secured in place, for example, by stitching 29 to form an eyelet 31. In a preferred form of the invention, the loop 27, which may be formed of the same material as the belt or of a different material, extends loosely through the eyelet 31 so that the loop is loosely retained at the eyelet end of the belt. (See also FIGS. 2 and 3). Importantly, the belt is uninterrupted by openings which are customarily formed in many standard belts for the purpose of receiving a buckle clasp.

In accordance with a prefered form of the invention, the loop is manually movable to be positioned at the front or rear side of the belt, and the loop, when positioned at the front side of the belt, is adapted to receive the free end 25 of the belt after the belt is wrapped around a user's waist, hips or other body part, the free end, after the belt is pulled taut, is adapted to be passed under and around the belt beyond the loop, and then manipulated to tie a knot to secure the belt in place. Preferably, the knot is formed when the free end is doubled back on itself and passed back through the loop 27.

As embodied herein, the belt 21 is wrapped around a user's waist to form the belt in substantially the shape shown in FIG. 4, and the free end 25 of the belt is passed through the loop 27 substantially as shown in that figure. After the belt has been pulled sufficiently taut, the free end 25 is passed under and around the belt beyond the loop 27, doubled back on itself, and then is passed back through the loop 27 which is sized so that the free end of the belt can pass through it at least twice, to secure the belt in place. This sequence of steps is illustrated in FIG. 5. The free end 25 is then pulled to tighten the knot so that the belt is now secured in place around the user's waist. (See FIG. 6).

Alternatively, the knot could be formed by passing the free end through the wrapping formed when the free end is passed under and around the belt beyond the loop and without passing the free end back through the loop. In either case, the free end hangs neatly in a downward direction.

Figure 7:
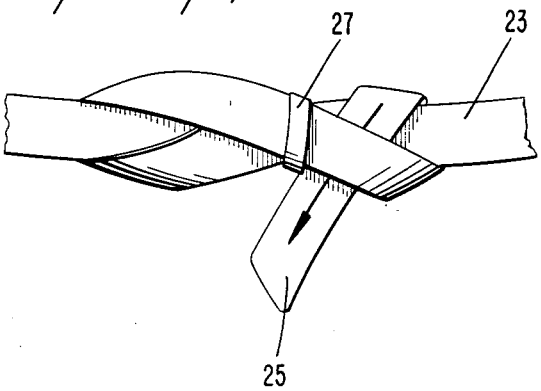
FIG. 7 is a view similar to FIG. 6 showing a final step of tying the free end of the belt.
Figure 8:
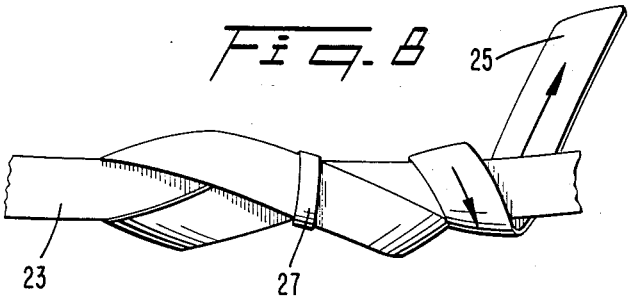
FIG. 8 is a view similar to FIG. 7 and showing how a still further excessive length of belt free end can be accomodated.
Figure 9:
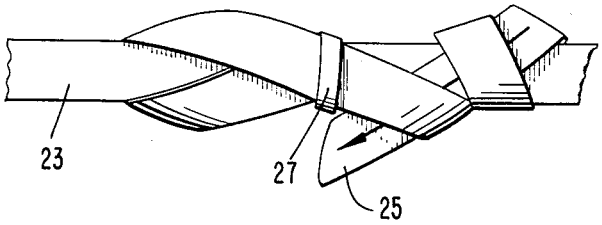
FIG. 9 is a view similar to FIG. 8 showing completion of the tying procedure.
Figure 10:
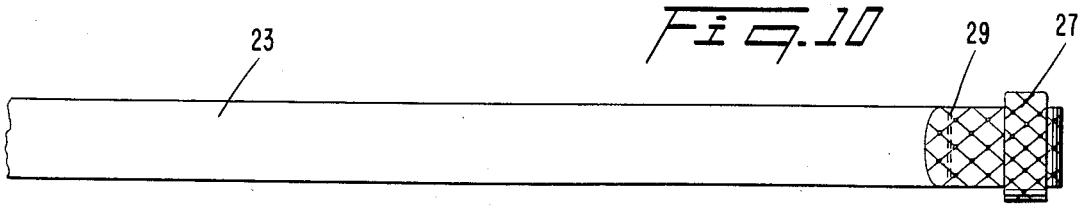
FIG. 10 is a view similar to FIG. 2 and showing the loop positioned at the rear side of the belt pursuant to use of the belt with a separate buckle.

For the reason that the belt of this invention is constructed to be nearly universal for use with a variety of waist or hip sizes, and may be constructed for alternative use with a separate buckle, as will be described below, it may be that an excessive length of free end 25 of the belt remains after the belt has been secured in place, as shown in FIG. 6. If desired, this length of free end 25 may be quickly and easily tied off simply by wrapping it around and under the belt material in front of the loop 27 and inserting it back through the wrapping forming a simple knot as shown in FIGS. 7. If still an additional excessive length of free end 25 exists, it may be wrapped around and under the belt material twice or more as shown in FIG. 8 and then inserted back through the wrappings as shown in FIG. 9. In all cases, the tied belt presents a neat and stylish appearance and one which is very desirable. This allows one belt length to accommodate a wide range of waist sizes making the belt of this invention nearly universal.

Figure 11:
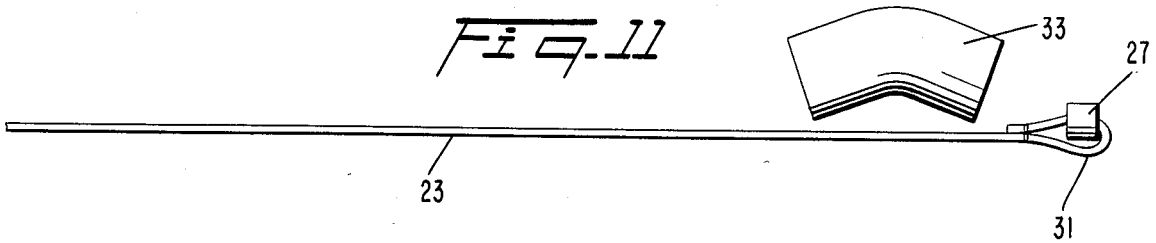
FIG. 11 is an elevational view of the structure of FIG. 10 and shown with a separate buckle first positioned on the belt.
Figure 12:
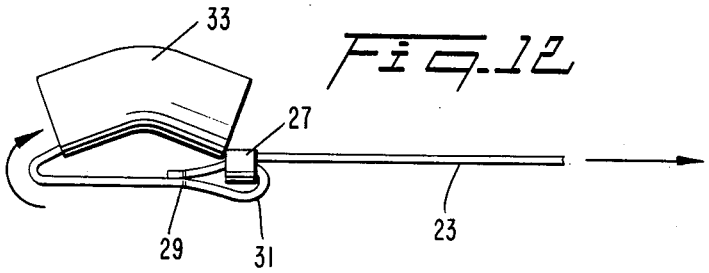
FIG. 12 is a view similar to FIG. 11 showing the manner in which the free end of the belt is moved to secure the buckle in place on the belt.

In accordance with the invention, the loop 27 is adapted to be positioned at the rear side of the belt whereupon a separate buckle can be positioned on the belt and secured in place by passing the free end of the belt through the buckle and then through the loop and pulling the belt tight on the buckle which is positioned adjacent the loop. As embodied herein and shown in FIGS. 10–15, the loop 27, which is loosely retained at the belt eyelet 31, is positioned at the rear side of the belt. A separate buckle 33 shown as tubular is positioned adjacent the belt, as shown in FIG. 11. The free end 25 of the belt is passed through the buckle 33 and then the loop 27 and then is pulled tight on the buckle as shown in FIG. 12 so that the buckle 33 is now secured in place on the belt. It will be understood that the buckle can be other than tubular, it only being necessary that the buckle have an aperture or opening through which the belt can pass as described.

Figure 13:
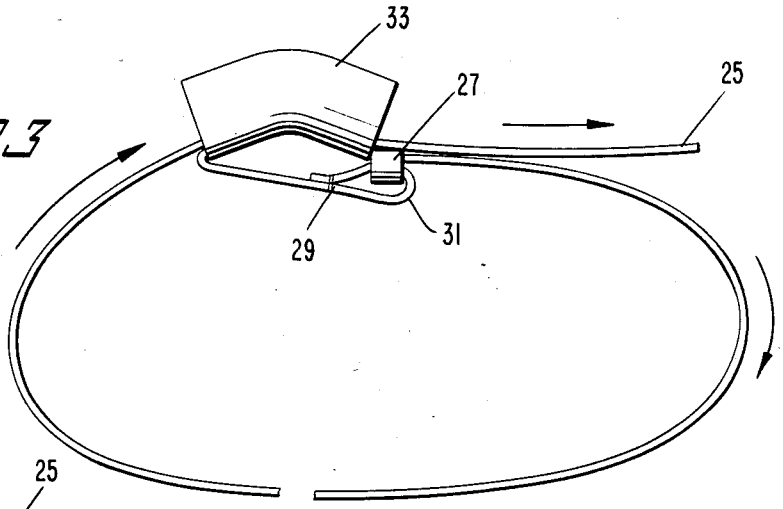
FIG. 13 is a top view of the belt with a separate buckle showing the position of the parts as would be with the belt wrapped around the waist of the user and the belt free end inserted through the buckle.
Figure 14:
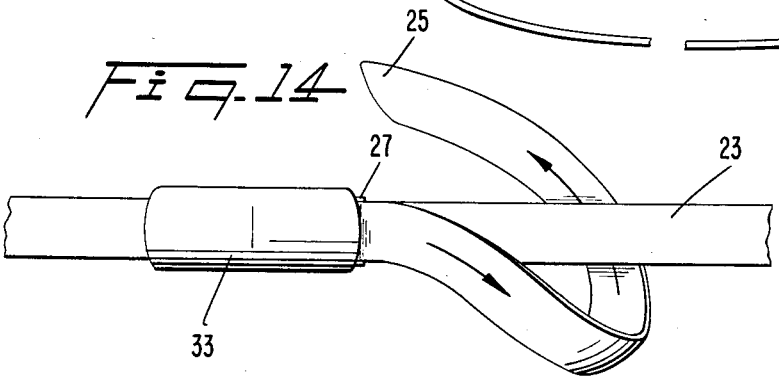
FIG. 14 is a front view of a portion of the structure of FIG. 13 and shown with the free end of the belt wrapped under and around the belt pursuant to tying the belt in position.
Figure 15:
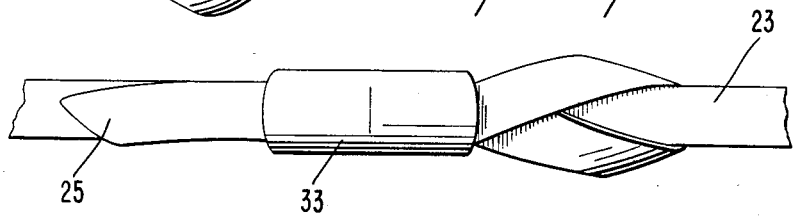
FIG. 15 is a view similar to FIG. 14 showing the free end of the belt doubled back on itself and passed through the buckle and the belt secured in place.

In accordance with the invention, the belt with the buckle secured thereon can now be secured in place around the user's waist by again passing the free end of the belt through the buckle, passing the free end under and around the belt beyond the buckle, and manipulating the free end to tie a knot. Preferrably, the knot is formed by doubling the free end of the belt back on itself and passing it back through the buckle. As embodied herein, the belt, with the buckle in place thereon, is positioned around the waist of the user and the free end 25 passed through the buckle 33 substantially as shown in FIG. 13. The free end 25 is then passed under and around the belt beyond the buckle 33 as shown in FIG. 14, and is manipulated to tie a knot, preferably by doubling it back on itself and passing it back through the buckle. Upon pulling the free end taut, the knot is tightened, as shown in FIG. 15, and the belt is secured in place. Preferrably, the buckle is sized so that the free end of the belt can pass through it at least twice after the buckle is secured to the belt. As was the case in the description of the use of the belt without a separate buckle, excessive length of free end 25 can be neatly tied off in the manner described above and shown in FIGS. 6–9.

It will be appreciated that the belt of this invention can be used with a number of buckles 33 of different colors, sizes and shapes as well as without a buckle. Change from one mode to the other can be made quickly and easily so that the belt of this invention can be worn with a wide variety of clothing styles and colors. Furthermore, it will be understood that the loop can be fixed at the rear side of the belt for use of the belt only with interchangeable buckles.

Still further, the belt of this invention can be worn by persons having different waist sizes and hip sizes, not only facilitating use of same belt by different persons but also reducing the inventory required at retail outlets where the belts are sold. Further yet, the belt of this invention is not subject to wear such as occurs with belts having standard buckles and clasps. Therefore, if a person's waist size grows or diminishes there are no wear marks on the belt which are exposed to view.

By the foregoing, there has been described a universal belt construction which can be worn with or without a number of different separate buckles in several different modes thereby accommodating use with a wide variety of fashion styles and colors. It will be apparent to those skilled in the art, however, that various additions, substitutions, modifications and omissions can be made to the belt of the present invention without departing from the scope or spirit of the invention. For example, and as described briefly above, the invention is not limited to belts which are worn around the waist or hips of a user but applies also to other band-like articles such as necklaces, bracelets, head bands, etc. Thus, it is intended that the present invention cover the additions, substitutions, modifications and omissions provided they come within the scope of the appended claims and their equivalents.

What is claimed is:

1. A belt or other band-like article adapted to be wrapped around a user's waist, hips or other body part and secured in place, said belt comprising a length of material having a rear side which faces the user's body part and a front side which faces away from the user's body part when the belt is in place, said belt having one free end, means at the other end of said belt retaining a loop at the front side of said belt and extending outwardly thereof, said loop being sized and constructed to freely receive the free end of the belt after the belt is wrapped around the user's waist, hips or other body part, and to freely receive the free end of the belt's a second time after the free end is passed under and around the belt beyond the loop, whereby to tie a knot in the belt.

2. The belt claimed in claim 1, said loop being loosely retained at the other end of said belt and being manually movable to be positioned at the front or the rear side of the belt, said belt, with said loop positioned at the rear side thereof, being adapted to have a separate buckle positioned thereon and secured in place by passing said free end through the buckle and then through said loop and pulling the belt tight on the buckle which is positioned adjacent the loop, whereupon said belt can be secured in place by again passing the free end of the belt through the buckle, pulling the belt taut, passing the free end under and around the belt beyond the buckle, and then manipulating the free end to tie a knot in the belt.

3. The belt claimed in claim 2, said knot being tied by doubling the free end of the belt back on itself, after it is passed under and around the belt beyond the buckle, and passing it back through the buckle.

4. The belt claimed in claim 3, said loop retaining means comprising an eyelet formed by folding a short length of the belt back on itself and securing it to the belt.

5. The belt claimed in claim 4, said loop being formed of the same material as the belt.

6. The belt claimed in claim 5, wherein excessive length of free end thereafter may be wrapped around and under the belt and folded back through itself.

7. A belt or other band-like article adapted to be worn around a user's waist, hips or other body part, said belt comprising a length of material and including a free end, means loosely retaining a loop at the other end of said belt, said loop selectively positionable at the front or rear side of the belt, said belt adapted to be worn in one mode wherein said free end is passed through said loop when positioned at the front side of said belt after the belt is wrapped around the user's waist, hips or other body part, said free end adapted to be passed under and around said belt beyond the loop, doubled back on itself and passed back through the loop to lock said belt in place, said belt adapted to be worn in another mode wherein a separate buckle is positioned and retained on said belt by passing said free end through said buckle and through said loop when positioned at the rear side of said belt, said belt being secured in place by passing said free end through said buckle again, passing said free end under and around said belt beyong said buckle, doubling it back on itself, and passing it back through said buckle.

8. The belt claimed in claim 7, said loop retaining means formed by folding a short length of said belt material back on itself and securing it in place forming an eyelet which receives said loop.

9. The belt claimed in claim 8, said loop being formed of the same material as said belt.

10. The belt claimed in claim 9, said buckle being formed of a material different from said belt.

11. A belt or band-like article adapted to be worn around a user's waist, hips or other body part, said belt comprising a length of material having a rear side which faces the user's body part and a front side which faces away from the user's body part when the belt is in place, said belt having a free end, means at the other end of said belt retaining a loop at the rear side of said belt and extending inwardly thereof, a buckle retained on said belt by passing the free end of said belt through the buckle and through the loop and pulling the belt tight on the buckle which is positioned adjacent the loop, said belt adapted to be worn around the waist, hips or other body part of a user by passing the free end through the buckle again, passing the free end under and around the belt beyond the buckle, and manipulating the free end to tie a knot in the belt.

12. The belt claimed in claim 11, said knot being formed by doubling the free end of the belt back on itself, after passing it under and around the belt beyond the buckle, and passing the free end back through the buckle.

13. A method of tying a belt or band-like article which includes the steps of providing a belt constructed of a length of material having a free end and a loop retained at its other end and disposed on the front side of the belt, wrapping the belt around the waist, hips or other body part of a user, passing the free end of the belt through the loop, passing the free end under and around the belt beyond the loop, and then doubling the free end of the belt back on itself and passing it back through the loop to tie a knot in the belt.

14. A method of tying a belt or band-like article which includes the steps of providing a belt constructed of a length of material having a free end and a loop retained at its other end and disposed on the rear side of the belt, positioning a buckle on the belt by passing the free end through the buckle and then the loop, wrapping the belt around the waist, hips or other body part of a user, passing the free end of the belt through the buckle, passing the free end under and around the belt beyond the buckle, and then manipulating the free end to tie a knot in the belt.

15. The method of claim 14 which includes the step of tying said knot by doubling the free end of the belt back on itself and passing it back through the buckle.

* * * * *

UNITED STATES PATENT AND TRADEMARK OFFICE

CERTIFICATE OF CORRECTION

PATENT NO. : 4,543,672

DATED : October 1, 1985

INVENTOR(S) : Ellen R. Levy

It is certified that error appears in the above-identified patent and that said Letters Patent is hereby corrected as shown below:

In the Claims:

Column 6, line 40, change "belt's" to --belt--;

Column 6, line 63, change "3" to --2--;

Column 6, line 67, change "4" to --2--;

Column 7, line 1, change "5" to --2--;

Column 7, line 29, change "8" to --7--;

Column 7, line 31, change "9" to --7--.

Signed and Sealed this

*Twenty-fourth* Day of *December 1985*

[SEAL]

*Attest:*

DONALD J. QUIGG

*Attesting Officer* *Commissioner of Patents and Trademarks*